United States Patent [19]

Nobu

[11] Patent Number: 4,569,313

[45] Date of Patent: Feb. 11, 1986

[54] COOLING WATER PATH FOR AN INTERNAL COMBUSTION ENGINE

[75] Inventor: Habuo Nobu, Susono, Japan

[73] Assignee: Toyota Jidosha Kabushiki Kaisha, Toyota, Japan

[21] Appl. No.: 678,810

[22] Filed: Dec. 6, 1984

[30] Foreign Application Priority Data

Dec. 9, 1983 [JP] Japan ..... 58-231479

[51] Int. Cl.[4] ..... F01P 3/02

[52] U.S. Cl. ..... 123/41.74; 123/41.79; 123/41.82 R

[58] Field of Search ..... 123/41.28, 41.72, 41.74, 123/41.79, 41.82 R, 41.82 A

[56] References Cited

U.S. PATENT DOCUMENTS

| | | | |
|---|---|---|---|
| 1,033,939 | 7/1912 | Robb et al. | 123/41.82 R |
| 2,010,782 | 8/1935 | Fahlman | 123/41.28 |
| 2,681,054 | 6/1954 | Boghossian | 123/41.74 |
| 4,175,503 | 11/1979 | Ernest | 123/41.79 |

FOREIGN PATENT DOCUMENTS

| | | | |
|---|---|---|---|
| 299551 | 3/1916 | Fed. Rep. of Germany | 123/41.79 |
| 55-96341 | 7/1980 | Japan | 123/41.74 |

*Primary Examiner*—William A. Cuchlinski, Jr.
*Attorney, Agent, or Firm*—Oblon, Fisher, Spivak, McClelland & Maier

[57] ABSTRACT

A cooling water path for an internal combustion engine characterized in that within a water jacket in the cylinder head there are installed a plurality of head partition walls located between adjacent cylinders extending the full width of the head with a ventilation hole provided at the top. Within a water jacket in the cylinder block there are installed a No. 1 block partition wall extending in the longitudinal direction of the block between adjacent cylinders as well as No. 2 block partition walls extending in the width direction of the block between adjacent cylinders or lateral to the cylinder center, said head water jacket and said block water jacket vertically communicating with each other.

15 Claims, 10 Drawing Figures

COOLING WATER PATH FOR AN INTERNAL COMBUSTION ENGINE

BACKGROUND OF THE INVENTION

1. Field of the Invention

The present invention relates to the structure of a cooling water path in an internal combustion engine, particularly to the structure of a cooling water path providing an improved cooling performance.

2. Description of the Prior Art

In a conventional auto internal combustion engine, for example in a four-cylinder engine, the cooling water runs through No. 1 cylinder block to the head, through the No. 2 cylinder block to the head, through the No. 3 cylinder block to the head, and through the No. 4 cylinder block to the head, which are independent of each other; and the cooling water, which flows into the cylinder, goes out of a cooling water hole installed at the front or the rear of the cylinder head. In this arrangement the cross-sectional areas of the cooling water holes provided for the cylinders within the cylinder head are about equal each other. Thus the cooling water runs fast at the end of the cylinder head located most downstream, but runs very slow at the end of the cylinder head located most upstream. As a result a number of stagnation areas occur where the flow is slow and they decrease the cooling performance, which may lead to a generation of hot spots in the cylinder wall and cause knocking in the engine. Moreover an uneven temperature distribution in the cylinder head and block may develop strain, resulting in a cracking of a cylinder head if it is exposed to a particularly high temperature.

SUMMARY OF THE INVENTION

To resolve the above-mentioned problem, the present invention has a main object a structural modification of the conventional cooling water path in the cylinder block and head of an internal combustion engine so that the cooling performance may be improved with no stagnation of water, and a generation of hot spots in the cylinder block and head may be prevented.

The water cooling path for an internal combustion engine according to the present invention comprises:

a cylinder head;

a plurality of cylinder head partition walls extending the full width of the cylinder head;

a head water jacket for each cylinder partitioned by the cylinder head partition walls installed within the cylinder head;

a cylinder block connected underneath the cylinder head;

a No. 1 block partition wall extending in the longitudinal direction of the block between adjacent cylinders in the cylinder block;

a plurality of No. 2 block partition walls extending in the transverse direction of the block;

a block water jacket partitioned by No. 1 and No. 2 block partition walls provided in the cylinder block, the block water jacket communicating vertically with the head water jacket;

and a cooling water inlet and a cooling water outlet provided in the cylinder block.

Practically, there can be the following variations of the No. 2 block partition walls to be installed in the cylinder block.

Thus in the first embodiment of the present invention the No. 2 block partition walls are provided only on one side of the No. 1 block partition wall between adjacent cylinders; and the block water jackets consists of a No. 1 block water jacket on one side of the No. 1 block partition wall extending the full length of the block and the No. 2 block water jackets on the other side of the No. 1 block partition wall, partitioned for each cylinder by No. 2 block partition walls.

In the second embodiment of the present invention the No. 2 block partition walls provided between adjacent cylinders are staggered in the longitudinal direction of the No. 1 block partition wall; and the block water jacket consists of No. 3 block water jackets on one side of the No. 1 block partition wall, partitioned by No. 2 block partition walls, and No. 4 block water jackets on the other side of the No. 1 block partition wall, partitioned by No. 2 block partition walls.

Further in the third embodiment of the present invention, No. 2 block partition walls are located lateral to the center of each cylinder on one side of the No. 1 block partition wall and are staggered in the longitudinal direction of the block; and the block water jacket consists of No. 5 block water jackets on one side of the No. 1 block partition wall, partitioned by No. 2 block partition walls and No. 6 block water jackets on the other side of the No. 1 block partition wall, partitioned by No. 2 block partition walls.

In the cooling water path thus arranged for the internal combustion engine, the water flows substantially evenly distributed to each cylinder or with a uniform flow rate through the cylinders arranged in series. As a consequence the volumes of water flowing through the cylinder blocks in each cylinder are substantially uniform and accordingly the flow rates too are uniform or approximately uniform.

Thus with the cooling performance in each cylinder about equal and no stagnation of cylinder wall caused, a generation of hot spots in the cylinder wall can be prevented. This will result in an enhanced anti-knocking effect and permit an increased compression ratio, which will lead to better fuel economy. Meanwhile temperature equalization in the cylinder block and head will inhibit cracking due to repetition of localized cooling and heating, thereby improving the structural reliability of the engine.

BRIEF DESCRIPTION OF THE DRAWINGS:

The above and other objects, features and advantages of the invention will become apparent and more readily appreciated from the following detailed description of present preferred exemplary embodiments of the invention, taken in conjunction with the accompanying drawings, wherein.

DETAILED DESCRIPTION OF THE PREFERRED EMBODIMENTS

Preferred embodiments of the present invention are to be described referring to the attached drawings.

Figure 1:
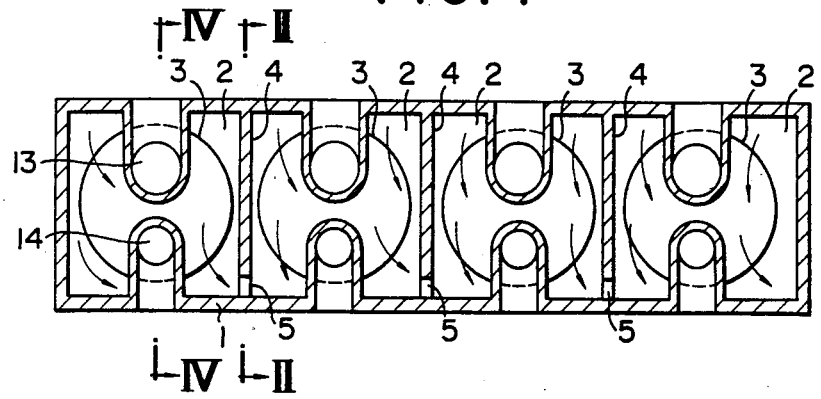
FIG. 1 is a sectional view of the cylinder head in the first embodiment of a cooling water path for the internal combustion engine according to the present invention.
Figure 2:
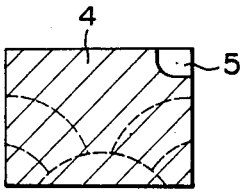
FIG. 2 is a sectional view along the line II—II in FIG. 1.
Figure 5:
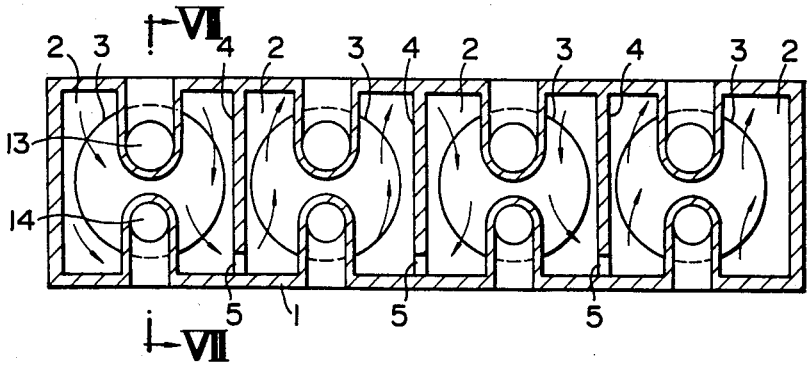
FIG. 5 is sectional view of the cylinder head in the second embodiment of a cooling water path for the internal combustion engine according to the present invention.
Figure 6:
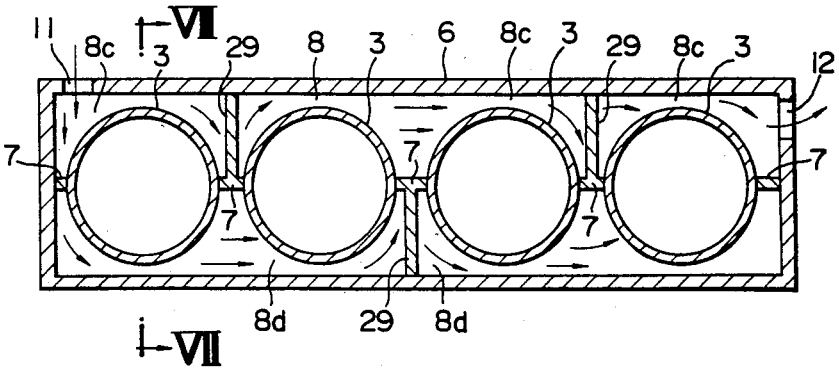
FIG. 6 is a sectional view of the cylinder block in the second embodiment.
Figure 7:
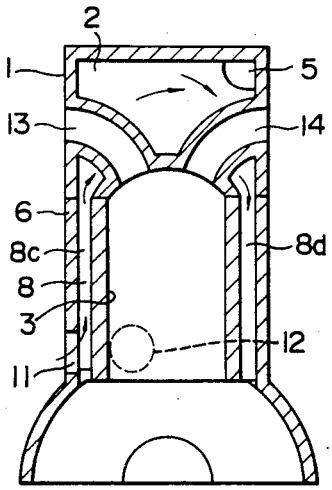
FIG. 7 is a sectional view along the line VII—VII in FIGS. 5 and 6.
Figure 8:
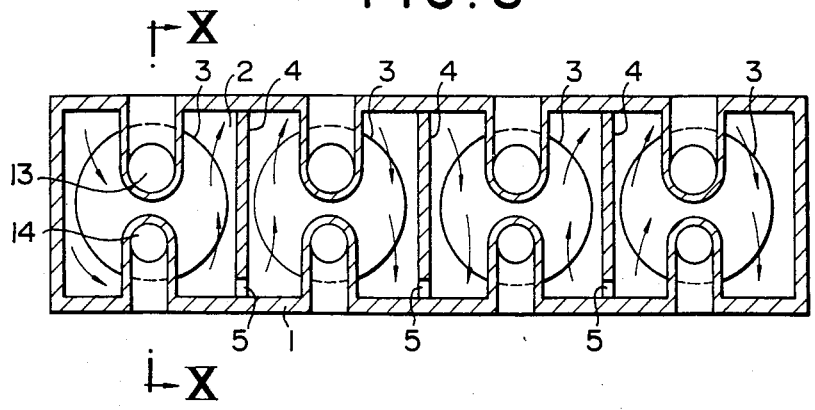
FIG. 8 is a sectional view of the cylinder head in the third embodiment of a cooling water path for the internal combustion engine according to the present invention.
Figure 9:
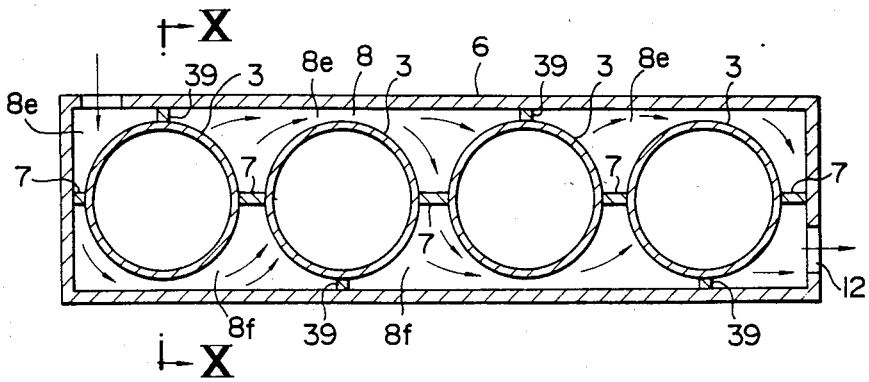
FIG. 9 is a sectional view of the cylinder block in the third embodiment.
Figure 10:
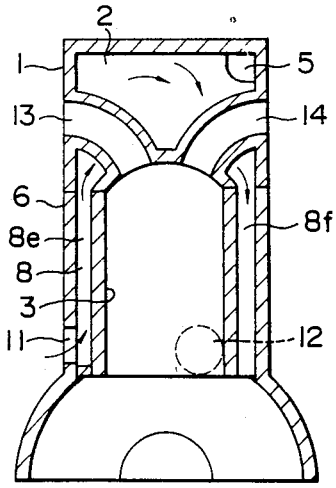
FIG. 10 is a sectional view along the line X—X in FIGS. 8 and 9.

FIGS. 1 to 4 illustrate the first embodiment, FIGS. 5 to 7 illustrate the second embodiment, and FIGS. 8 to 10 illustrate the third embodiment, of the present invention. First, the common items to all the three embodiments will be described. In FIGS. 1, 5 and 8 is shown a cross-section of the cylinder head in a 4-cylinder engine. The head water jacket 2 in the cylinder head 1 has between adjacent cylinders 3, head partition walls 4 extending to the full width of the head in the head width direction. Therefore the head water jacket 2 is partitioned for each cylinder by the head partition walls 4. As indicated in FIGS. 2, 7 and 10, the head partition wall 4 is provided at its top with a ventilation hole 5 for escape of air. The ventilation hole 5 is preferably provided at a position corresponding to an uppermost position of the head partition wall 4 when the cylinder head 1 and a cylinder block 6 is slantly mounted.

Such a ventilation hole 5 is located opposite to the cooling water inlet 11 of the cylinder block 6 with reference to a line connecting the center of each cylinder 3.

The cylinder head 1 is provided with an intake port 13 and an exhaust port 14 for each cylinder. The intake port 13 is located on the side of the cooling water inlet 11 as viewed from a line connecting the center of each cylinder 3, while the exhaust port 14 is located on the opposite side to the cooling water inlet 11 as viewed from a line connecting the center of each cylinder 3.

Figure 3:
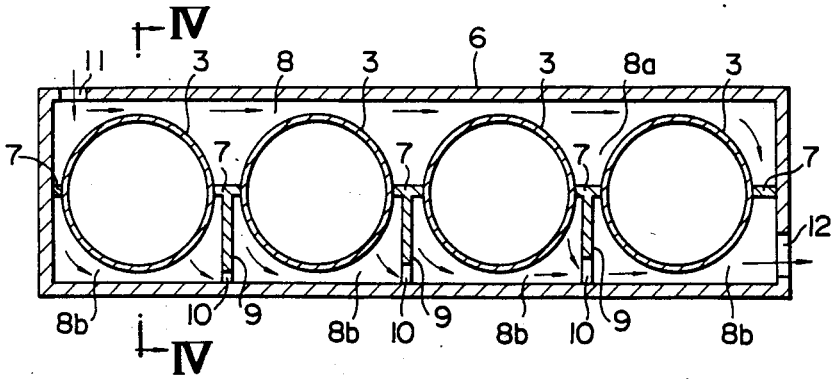
FIG. 3 is a sectional view of the cylinder block in the first embodiment.
Figure 4:
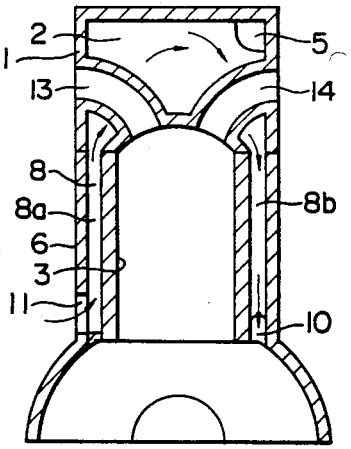
FIG. 4 is a sectional view along the line IV—IV in FIGS. 1 and 3.

FIGS. 3, 6 and 9 illustrate a cross section of the cylinder block 6 connected to, and beneath, the cylinder head 1. The cooling water inlet 11 and the cooling water outlet 12 are located in the cylinder block 6.

The cooling water inlet 11 is provided at one end of the cylinder block 6 in the longitudinal direction, while the cooling water outlet 12 is provided at the other longitudinal end of the cylinder block 6. In the cylinder block 6 there is, extending along the line connecting the center of each cylinder, a No. 1 block partition wall 7 extending between the cylinders 3 and 3 in the longitudinal direction. The No. 1 block partition wall 7 divides the block water jacket 8 within the cylinder block 6 into two parts on either side thereof. In the cylinder block 6 there are also provided No. 2 block partition walls 9, 29 or 39. The No. 2 block partition walls 9, 29 or 39 are situated just beneath a part of each head partition wall 4. Thus the block water jacket 8 is partitioned by means of the No. 1 block partition wall 7 and the No. 2 block partition walls 9, 29 or 39. The head water jacket 2 and the block water jacket 8 communicate vertically to each other.

Next, differences between the illustrated embodiments will be described.

First Embodiment

FIGS. 1 to 4 relate to the first embodiment of the present invention.

As seen from FIG. 3, in the first embodiment the No. 2 block partition walls 9 are provided between adjacent cylinders 3 and they are provided only on one side of the No. 1 block partition wall 7 in the block width direction, so that the block water jacket 8 consists of the No. 1 block water jacket 8*a* on one side of the No. 1 block partition wall 7, extending to the full length of the block and the No. 2 block water jackets 8*b* on the other side of the No. 1 block partition wall, partitioned for each cylinder by No. 2 block partition walls 9. As seen from FIGS. 3 and 4 there is provided a cooling water hole 10 at the bottom of each No. 2 block partition wall 9. The open area of the cooling water hole 10 is made wider for downstream partition walls 9. The cooling water inlet 11 is located in No. 1 block water jacket 8*a*, while the cooling water outlet 12 is located in the No. 2 block water jacket 8*b*.

In the first embodiment, as indicated in FIGS. 1 and 3 the cooling water flows in a path as follows: cooling water inlet 11 of cylinder block 6—the No. 1 block water jacket 8*a* extending over full length of the cylinder block 6 —head water jacket 2 of cylinder head 1 ( from intake port 13 side toward exhaust port 14 side )—each No. 2 block water jacket 8*b* corresponding to each cylinder—cooling water holes 10—cooling water outlet 12 of cylinder block 6.

In the first embodiment thus arranged, the cooling water flows following the above-mentioned course and thereby cools the cylinder head 1 and the cylinder block 6. In this arrangement, since an independent path of the cooling water is constituted for each cylinder and the open area of the cooling water hole 10 is made progressively wider toward downstream, the volumes of the cooling water flowing through the water jackets 2, 8 of each cylinder, particularly through the water jacket 2 in the cylinder head 1 of each cylinder can be made uniform. As a consequence the flow rates can be made equal with no stagnation of water being caused. Accordingly with the temperatures in the cylinder head 1 and the cylinder block 6 equalized, the temperatures in the cylinder head 1 and the cylinder block 6 can be effectively lowered.

Second Embodiment

FIGS. 5 to 7 illustrate the second embodiment of the present invention.

In the second embodiment, as shown in FIG. 6, No. 2 block partition walls 29 are provided between adjacent cylinders 3 and, located on either side of the No. 1 block partition wall 7, they are staggered with reference to the longitudinal direction of the block. Block water jacket 8 consists of the No. 3 block water jackets 8*c* on one side of the No. 1 block partition wall 7, partitioned by the No. 2 block partition walls 29, and the No. 4 block water jackets 8*d* on the other side of No. 1 block partition wall 7, partitioned by the No. 2 block partition walls 29. The cooling water inlet 11 is provided in a No. 3 block water jacket 8*c*, and the cooling water outlet 12 is also located in a No. 3 block water jacket 8*c*. The role of the cooling water hole 10 of the first embodiment is here played by the space in the water jacket 8 where a No. 2 block partition wall 29 does not exist.

In the second embodiment as indicated in FIGS. 5 and 6 the cooling water flows the course: water inlet 11 of cylinder block 6—No. 3 block water jacket 8*c* of No. 1 cylinder—head water jacket 2 of No. 1 cylinder—No. 4 block water jacket 8*d* of No. 1 cylinder—No. 4 block water jacket 8*d* of No. 2 cylinder—head water jacket 2 of No. 2 cylinder—No. 3 block water jacket 8*c* of No. 2 cylinder—No. 3 block water jacket 8*c* of No. 3 cylinder—head water jacket 2 of No. 3 cylinder—No. 4 block water jacket 8*d* of No. 3 cylinder—No. 4 block water jacket 8*d* of No. 4 cylinder—head water jacket 2 of No. 4 cylinder—No. 3 block water jacket 8*c* of No. 4 cylinder—water outlet 12 of cylinder block 6.

In the second embodiment thus constituted, the cooling water flows following the above-mentioned course and thereby cools the cylinder head 1 and the cylinder block 6. Since the total volume of the cooling water passes through one cylinder to another arranged in series, the volume of the water flowing in each cylinder is identical and accordingly the flow rate is also identical; thus with no stagnation generated, the cooling can be done effectively.

Third Embodiment

FIGS. 8 to 10 illustrate the third embodiment of the present invention. In the third embodiment the No. 2 block partition wall 39 is provided on either side of the No. 1 block partition wall 7 as viewed from the center of each cylinder and the partition walls 39 are staggered in the longitudinal direction of the block 6. The block water jacket 8 consists of No. 5 block water jackets 8*e* on one side of the No. 1 block partition wall 7, partitioned by No. 2 block partition walls 39 and No. 6 block water jackets 8*f* on the other side of No. 1 block partition wall 7, partitioned by No. 2 block partitions walls 39. The cooling water inlet 11 is provided at a No. 5 block water jacket 8*e*, while the cooling water outlet 12 is provided at a No. 6 block water jacket 8*f*. The water jacket space 8 where a No. 2 block partition wall 39 does not exist serves as a cooling water path corresponding to the cooling water hole 10 in the first embodiment.

In the third embodiment, as shown in FIGS. 8 and 9 the cooling water path is constituted as follows; water inlet 11 of cylinder block 6—No. 5 block water jacket 8*e* of No. 1 cylinder—head water jacket 2 of No. 1 cylinder—No. 5 block water jacket 8*e* of No. 1 cylinder and No. 6 block water jacket 8*f* of No. 1 cylinder—No. 5 block water jacket 8*e* of No. 2 cylinder and No. 6 block water jacket 8*f* of No. 2 cylinder—No. 5 block water jacket 8*e* of No. 2 cylinder and head water jacket 2 of No. 2 cylinder—No. 5 block water jacket 8*e* of No. 3 cylinder, No. 6 block water jacket 8*f* of No. 2 cylinder and No. 6 block water jacket 8*f* of No. 3 cylinder—head water jacket 2 of No. 3 cylinder and No. 6 water jacket 8*f* of No. 3 cylinder—No. 5 block water jacket 8*e* of No. 3 cylinder, No. 6 block water jacket 8*f* of No. 3 cylinder and No. 6 block water jacket 8*f* of No. 4 cylinder—No. 5 block water jacket 8*e* of No. 4 cylinder and head water jacket 2 of No. 4 cylinder—No. 6 block water jacket 8*f* of No. 4 cylinder—water outlet 12 of cylinder block 6.

In the third embodiment thus constituted, the cooling water, flowing in the above-mentioned course, cools the cylinder head 1 and the cylinder block 6. Since in this embodiment the cooling water flows successively through the cylinders arranged in series, the water volume in each cylinder is identical and therefore the flow rate is also identical; thus with no stagnation caused in the flow, the cooling can take place effectively.

According to the present invention, existence of the partition wall prevents any stagnation in the flow of the cooling water and an equal or about equal volume of water can be circulated through each cylinder with the result that each part of the engine can have the same temperature.

Such temperature equalization inhibits knocking and permits, a higher compression ratio, thereby improving the fuel economy. Temperature equalization brings about other effects of eliminating the hazard of cylinder head cracking and raising the structural reliability of the engine.

The above description refers to a 4-cylinder engine, but the present invention is applicable to engines other than a 4-cylinder one.

Although only preferred embodiments of the present invention have been described in detail, it will be appreciated by those skilled in the art that various modifications and alterations can be made of the particular embodiment shown without materially departing from the novel teaching and advantages of this invention. Accprdingly, it is to be understood that all such modifications and alterations are included within the scope of the invention as defined by the following claims.

What is claimed is:

1. A cooling water path for an internal combustion engine, said cooling water path comprising:

a cylinder head;

a plurality of head partition walls installed between adjacent cylinders in said cylinder head, each of said partition walls extending a full width of said cylinder head;

a head water jacket partitioned for each cylinder by said head partition walls;

a cylinder block provided beneath said cylinder head;

a No. 1 block partition wall located between adjacent cylinders in said cylinder block, said No. 1 block partition wall extending in the longitudinal direction of the block;

a plurality of No. 2 block partition walls extending in the width direction of said cylinder block;

a block water jacket partitioned by said No. 1 block partition wall and No. 2 block partition walls in said cylinder block and vertically communicating with said head water jacket;

and a cooling water inlet and a cooling water outlet in said cylinder block.

2. The cooling water path of claim 1, wherein said No. 1 block partition wall is provided on a line connecting the centers of the cylinders.

3. The cooling water path of claim 1, wherein each said head partition wall is provided at its top with a ventilation hole.

4. The cooling water path of claim 3, wherein said ventilation hole is provided at a position corresponding to an uppermost position of said head partition wall when the cylinder head and the cylinder block are slantly mounted.

5. The cooling water path of claim 3, wherein said ventilation holes are provided on the opposite side to said cooling water inlet with reference to said No. 1 block partition wall.

6. The cooling water path of claim 1, wherein said No. 2 block partition walls are provided just beneath a part of said head partition wall.

7. The cooling water path of claim 1, wherein an intake port provided in said cylinder head is provided on the side of said cooling water inlet with reference to said No. 1 block partition wall, while an exhaust port provided in said cylinder head is provided on the opposite side to said cooling water inlet with reference to said No. 1 block partition wall.

8. The cooling water path of claim 1, wherein said No. 2 block partition walls are provided between adjacent cylinders and said No. 2 block partition walls are provided only on one side of said No. 1 block partition wall in the block width direction; and said block water jacket consists of a No. 1 block water jacket on one side of said No. 1 block partition wall, said No. 1 block water jacket extending over a full length of the block, and a plurality of No. 2 block water jackets on the other side of said No. 1 block partition wall, said No. 2 block water jacket being partitioned for each cylinder by said No. 2 block partition walls.

9. The cooling water path of claim 8, wherein said cooling water inlet is provided in said No. 1 block water jacket and said cooling water outlet is provided in said No. 2 block water jacket.

10. The cooling water path of claim 8, wherein said No. 2 block partition walls are each provided with a cooling water hole for the cooling water.

11. The cooling water path of claim 10, wherein the sectional area of said cooling water hole in each said No. 2 block partition wall is made wider in a downstream direction.

12. The cooling water path of claim 1, wherein said No. 2 block partition walls are provided between adjacent cylinders, and said No. 2 block partition walls are provided on one side of said No. 1 block partition wall and are staggered in the longitudinal direction of the block; and said block water jacket consists of a plurality of No. 3 block water jackets on one side of said No. 1 block partition wall, partitioned by said No. 2 block partition walls and a plurality of No. 4 block water jackets on the other side of said No. 1 block partition wall, partitioned by said No. 2 block partition walls.

13. The cooling water path of claim 12, wherein said cooling water inlet is located in one said No. 3 block water jacket and said cooling water outlet is also located in a No. 3 block water jacket.

14. The cooling water path of claim 1, wherein said No. 2 block partition walls are located in alignment with a center of each cylinder on one side of said No. 1 block partition wall and are staggered in the longitudinal direction of the block; and said block water jacket consists of a plurality of No. 5 block water jackets on one side of said No. 1 block partition wall, partitioned by said No. 2 block partition walls and a plurality of No. 6 block water jackets on the other side of said No. 1 block partition wall, partitioned by said No. 2 block partition walls.

15. The cooling water path of claim 14, wherein said cooling water inlet is located at one said No. 5 block water jacket and said cooling water outlet is located at another said No. 6 block water jacket.

* * * * *